US007216842B2

(12) United States Patent
Watson

(10) Patent No.: US 7,216,842 B2
(45) Date of Patent: May 15, 2007

(54) POCKET FORMER

(75) Inventor: Virgil Allen Watson, Salem, IA (US)

(73) Assignee: Lomont Molding, Inc., Mt. Pleasant, IA (US)

( * ) Notice: Subject to any disclaimer, the term of this patent is extended or adjusted under 35 U.S.C. 154(b) by 135 days.

(21) Appl. No.: 10/917,004

(22) Filed: Aug. 12, 2004

(65) Prior Publication Data

US 2006/0033003 A1 Feb. 16, 2006

(51) Int. Cl.
*B28B 7/28* (2006.01)
*B28B 21/60* (2006.01)
*B28B 23/06* (2006.01)

(52) U.S. Cl. ..... 249/177; 249/35; 249/59; 249/63; 249/91; 249/97; 249/142; 249/217; 249/190; 425/111; 264/228; 52/223.13

(58) Field of Classification Search ..... 249/35, 249/59, 63, 91, 97, 142, 217; 425/111; 52/223.13
See application file for complete search history.

(56) References Cited

U.S. PATENT DOCUMENTS 3,137,971 A * 6/1964 Rhodes ..... 52/223.13
3,766,609 A * 10/1973 Brandestini et al. ..... 24/115 R
3,985,482 A * 10/1976 Suzuki ..... 425/111
4,363,462 A * 12/1982 Wlodkowski et al. ..... 249/190
4,773,198 A 9/1988 Reinharadt
5,271,199 A 12/1993 Northern
5,423,362 A * 6/1995 Knight ..... 249/91
5,433,362 A 7/1995 Battaglia
2004/0148880 A1 * 8/2004 Hayes ..... 52/223.1

* cited by examiner

*Primary Examiner*—Yogendra N. Gupta
*Assistant Examiner*—Dimple Bodawala

(57) ABSTRACT

A pocket former includes an outer barrel having a first rim, a second rim and a frustoconical body portion extending from the first rim to the second rim. A center barrel is connected to the outer barrel and has a proximal lip adjacent the first rim of the outer barrel, a distal lip adjacent the second rim of the outer barrel, and a tubular body portion extending from the proximal lip to the distal lip, and extends beyond both the first rim and the second rim. An annular flange curves out and away from the second rim of the outer barrel. A spiral surface is located on the frustoconical body portion of the outer barrel. A nut surface is located on the tubular body portion of the center barrel adjacent the distal lip.

16 Claims, 6 Drawing Sheets

POCKET FORMER

BACKGROUND OF THE INVENTION

The present invention relates to the field of post-tensioning concrete structures, and the methods and apparatus for forming the same. More particularly, the invention relates to a pocket former and methods of forming a pocket surface for assembling a post-tensioning concrete structure.

Post-tensioning is a process where high strength cables are embedded in concrete and tensioned after the concrete cures. The residual tension that is retained in the cable increases the tinsel strength of the finished concrete structure. Cable ends are secured within the concrete with specially designed steel anchors. Cable assemblies are premanufactured specifically for a given job. The cable assemblies include a complete assembled anchor on the "dead end" and a "free end" that is assembled on the job site.

The free end assembly is comprised of a standard anchor to transfer cable tension to the concrete, tapered retainer keys to secure the cable to the anchor, a pocket former to create a void in the concrete where tensioning jacks are attached to the cable, and finally grout to seal the finished assembly.

Removal of the pocket former after the concrete has cured is usually done by gripping the plastic ribs and pulling or prying the pocket former out of the pocket. This often causes serious damage to the pocket former making them non-reusable. Additionally, during concrete placement, concrete occasionally leaks between the second rim of the pocket former and the concrete form. This leaked concrete hardens and prevents the removal of the pocket former.

Therefore, a principal object of this invention is to provide a pocket former that reduces the incidence of concrete leakage between the second rim of the pocket former and the concrete form.

Another object of the invention is to provide an improved method and apparatus for applying removal forces to the pocket former that minimizes damage to the pocket former.

A further object of the invention is to provide a pocket former that produces a concrete void or pocket with improved surface geometry to promote adhesion of grout.

These and other objects will be apparent to those skilled in the art.

BRIEF SUMMARY OF THE INVENTION

A pocket former includes an outer barrel having a first rim, a second rim and a frustoconical body portion extending from the first rim to the second rim. A center barrel is connected to the outer barrel and has a proximal lip adjacent the first rim of the outer barrel, a distal lip adjacent the second rim of the outer barrel, and a tubular body portion extending from the proximal lip to the distal lip, and extends beyond both the first rim and the second rim. An annular flange curves out and away from the second rim of the outer barrel. A spiral surface is located on the frustoconical body portion of the outer barrel. A nut surface is located on the tubular body portion of the center barrel adjacent the distal lip.

DETAILED DESCRIPTION OF THE PREFERRED EMBODIMENT

Figure 1:
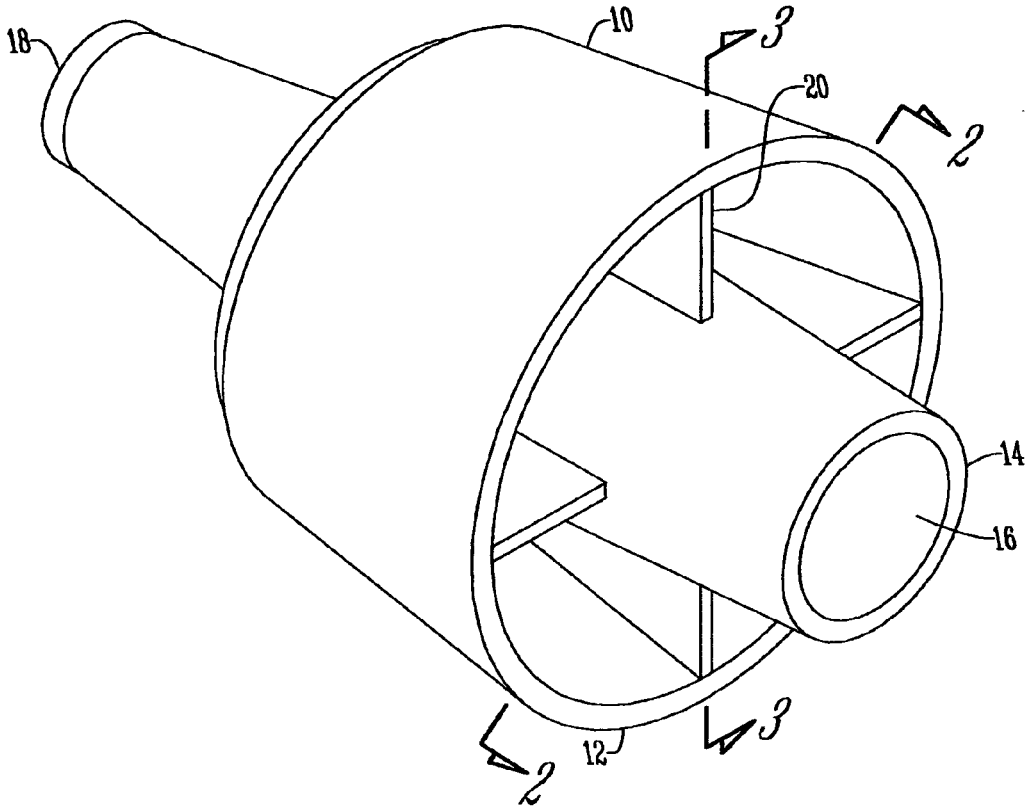
Prior Art Fig. 1
FIG. 1 is a perspective view of a pocket former of conventional configuration.
Figure 3:
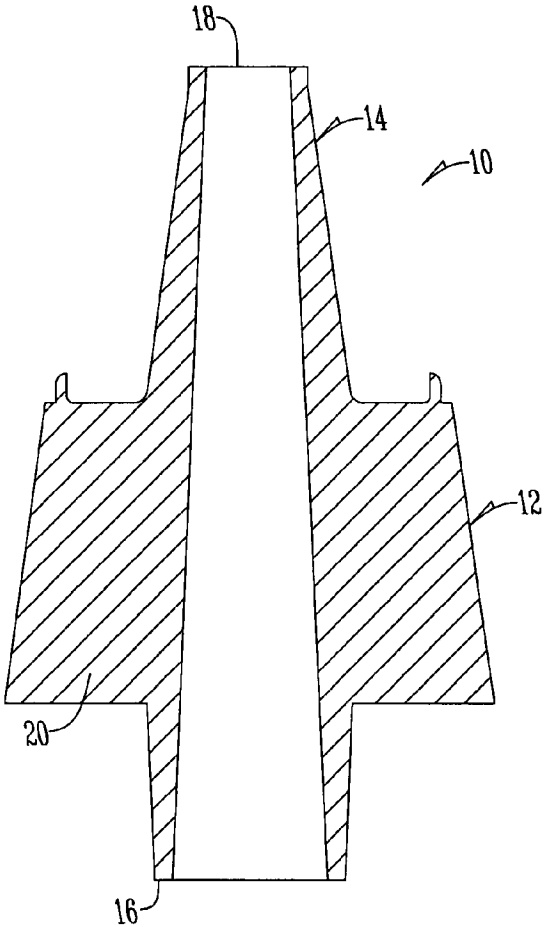
Prior Art Fig. 3
FIG. 3 is a sectional side view of the pocket former of conventional configuration taken on line 2—2 of FIG. 1.
Figure 2:
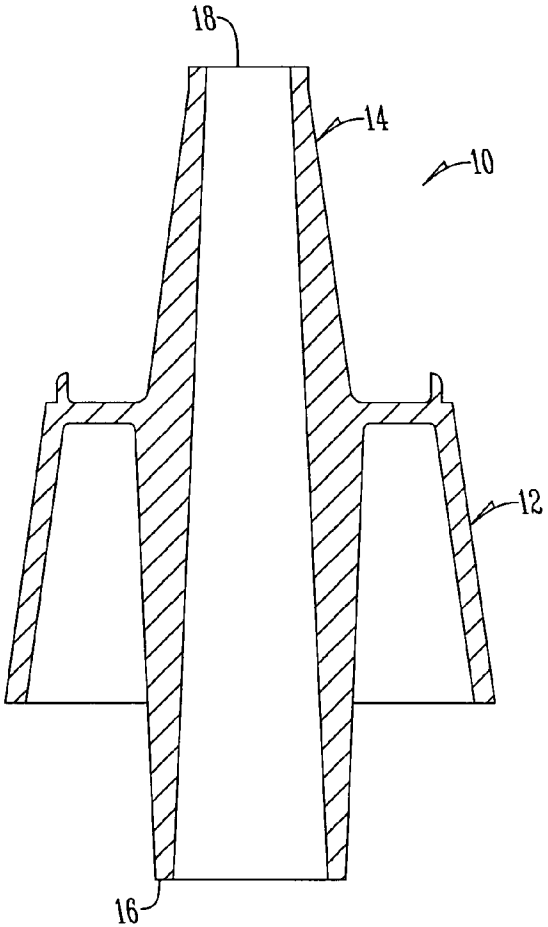
Prior Art Fig. 2
FIG. 2 is a sectional side view of the pocket former of conventional configuration taken on line 1—1 of FIG. 1.
Figure 4:
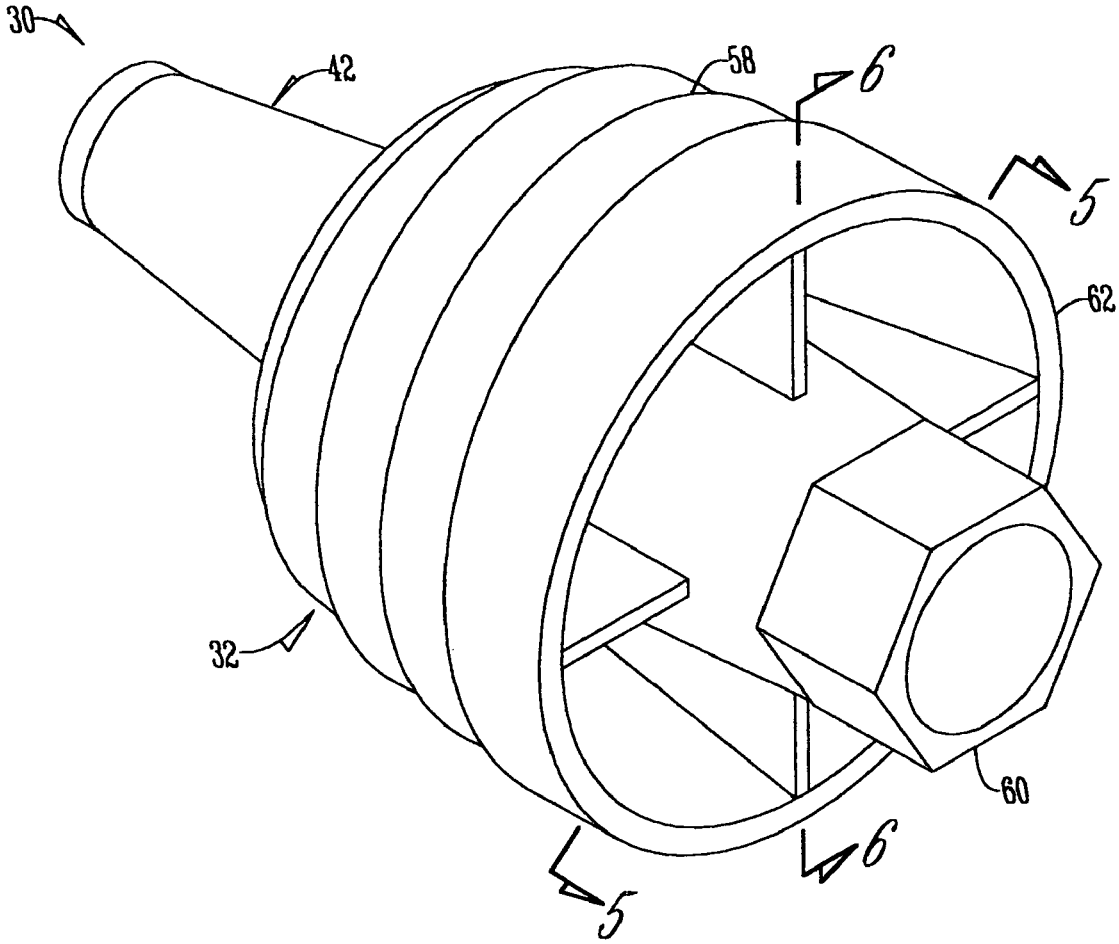
FIG. 4 is a perspective view of a pocket former of the present invention.

Referring to FIGS. 1–3, there is shown the conventional prior art pocket former 10. The conventional pocket former 10 includes a body portion 12 with a tubular member 14 extending therethrough. The body portion 12 has a generally frustoconical configuration. The tubular member 14 extends centrally through the frustoconical configuration of the body portion 12. The tubular member 14 is generally tapered from end 16 downwardly toward end 18. The tubular member 14 serves to allow a cable to extend centrally therethrough. Similarly, the body portion 12 is tapered downwardly in the direction toward end 18. A plurality of struts 20 extend between the tubular member 14 and the inside of the body portion 12.

Unfortunately, the configuration of the pocket former 10 of the prior art does not facilitate the ability to remove the pocket former 10 after concrete has cured. The prior art method of removing the pocket former 10 is usually done by gripping the struts 20 and pulling or prying the pocket former 10 out of the pocket. As noted above, this often causes serious damage to the pocket former 10 making them non-reusable. Additionally, during concrete placement, concrete occasionally leaks between the pocket former 10 and the concrete form. The leaked concrete hardens and prevents the removal of the pocket former 10.

Figure 6:
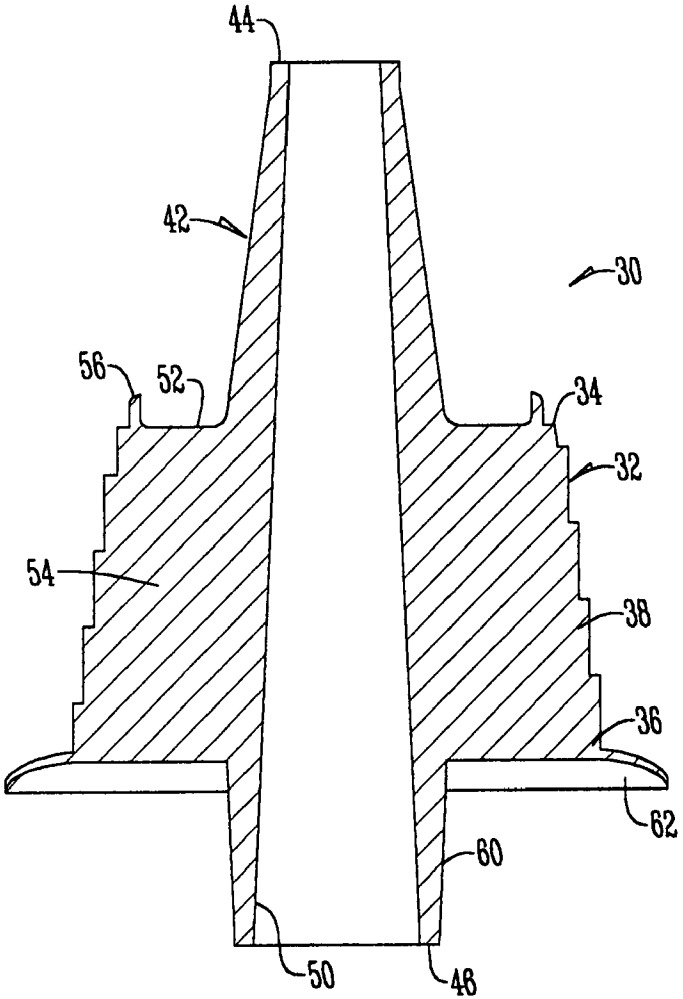
FIG. 6 is a sectional side view of the pocket former of the present invention taken on line 6—6 of FIG. 4.
Figure 5:
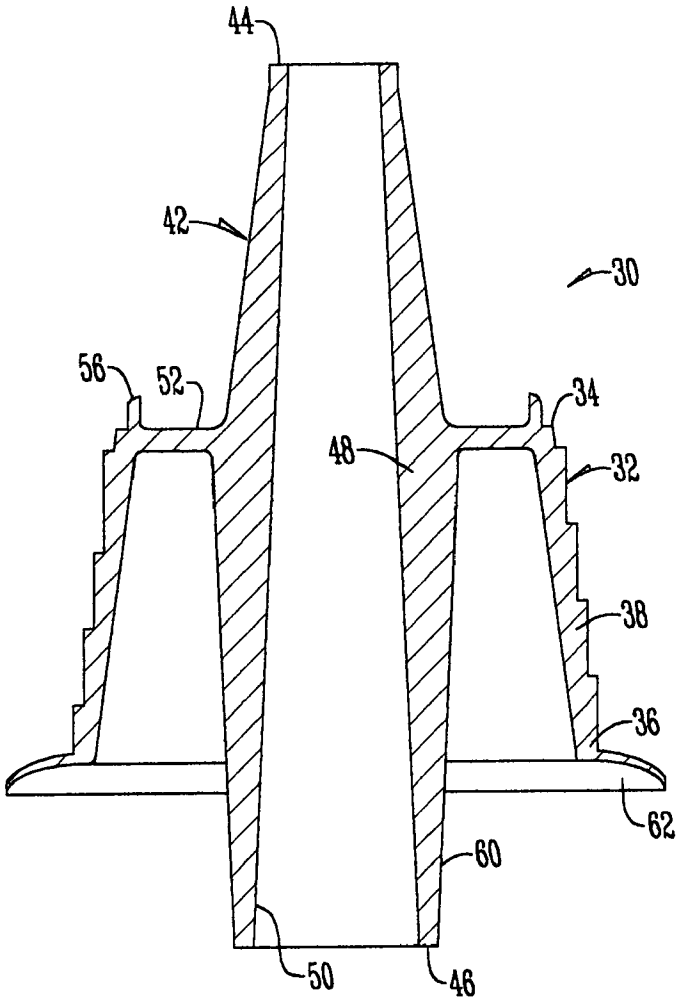
FIG. 5 is a sectional side view of the pocket former of the present invention taken on line 5—5 of FIG. 4.

With reference to FIGS. 5 and 6, the pocket former 30 of the present invention is shown. The pocket former 30 of the present invention includes an outer barrel 32 having a first rim 34, a second rim 36 and a frustoconical body portion 38 extending from the first rim 34 to the second rim 36.

A center barrel 42 is positioned centrally within the outer barrel 32 and extends beyond both the first rim 34 and the second rim 36. The center barrel 42 has a proximal lip 44 adjacent the first rim 34 of the outer barrel 32; a distal lip 46 adjacent the second rim 36 of the outer barrel 32; and a tubular body portion 48 extending from the proximal lip 44 to the distal lip 46. The tubular body portion 48 has a central opening 50 therethrough, extending from the proximal lip 44 to the distal lip 46. The tubular body portion 48 is generally tapered near the proximal lip 44. The central opening 50 serves to allow a cable (not shown) to extend centrally therethrough.

An annular shoulder 52 connects the first rim 34 of the outer barrel 32 to the tubular body portion 48 of the center barrel 42. The annular shoulder 52 is oriented to be generally perpendicular to the longitudinal axis of both the outer barrel 32 and the center barrel 32. A plurality of cross ribs 54 extend between the tubular body portion 48 of the center barrel 42 and the frustoconical body portion 38 of the outer barrel 32. The cross ribs 54 are oriented to extend radially from the longitudinal axis of both the outer barrel 32 and the center barrel 32. An annular ridge 56 is positioned adjacent the first rim 34 of the outer barrel 32 on the annular shoulder 52, and extends outwardly from the annular shoulder 52 in the direction of the proximal lip 44 of the center barrel 42. The center barrel 42 and the outer barrel 42 are integrally formed together.

A spiral surface 58 is provided on the frustoconical body portion 38 of outer barrel 32. The spiral surface 58 is formed as threads or a spiral shape molded on the outer surface of the outer barrel 32. The spiral surface 58 provides improved mechanical properties for removing the pocket former 30 from the concrete. The operator can remove the pocket former 30 with a rotating motion instead of a pulling motion. With the rotating motion, the spiral surface 58 substantially improves the mechanical advantage a person can exert upon the pocket former 30 in much the same way that a screw jack can be used to lift a heavy load. Thus, this feature of the spiral surface 58 substantially reduces the damage to the pocket former 30 improving its reusability, and reduces operator fatigue and the potential for injury.

A nut surface 60 is provided on the tubular body portion 48 of the center barrel 42, adjacent the distal lip 46. The nut surface 60 is formed of any desired geometry, such as hexagonal, square, or the like. The nut surface 60, as shown has a tapered hexagonal shape that provides a convenient surface for applying rotational force on the pocket former 30 by a standard hand tool such as a wrench, pliers or the like. Additionally, the hexagonal shape of the nut surface 60 further strengthens the pocket former 30 improving its reusability after removal.

Additionally, as the provision of nut surface 60 allows the application of rotational force to the center barrel 42 of the pocket former 30, this results in the center barrel 42 rotating its position relative to the outer barrel 32. In this condition, the ribs 54 that attach the center barrel 42 to the outer barrel 32 foreshorten thereby pulling the outer barrel 32 inward and away from the surrounding concrete. This reduction in the diameter of the outer barrel 32 further reduces the work energy required to remove the pocket former 30.

An annular flange 62 curves out and away from the second rim 36 of the outer barrel 32. The annular flange 62 is integrally molded on the outer rim of the pocket former and compensates for surface irregularities of the concrete form and any misalignments caused by improper installation. The annular flange 62 forms a seal or gasket between the concrete substrate and the concrete form. This seal reduces the incidence of concrete leakage thereby improving the likelihood the pocket former 30 can be removed without damage. That reduction of concrete leakage eliminates the labor costs associated with chiseling or removal of this concrete prior to pocket former 30 removal.

It will be understood that while the embodiment described above included all three features of the integral seal or gasket, the tapered hexagonal shape, and the thread or spiral surface; a pocket former of the present invention will include one of these features alone or in any combination thereof.

Figure 7:
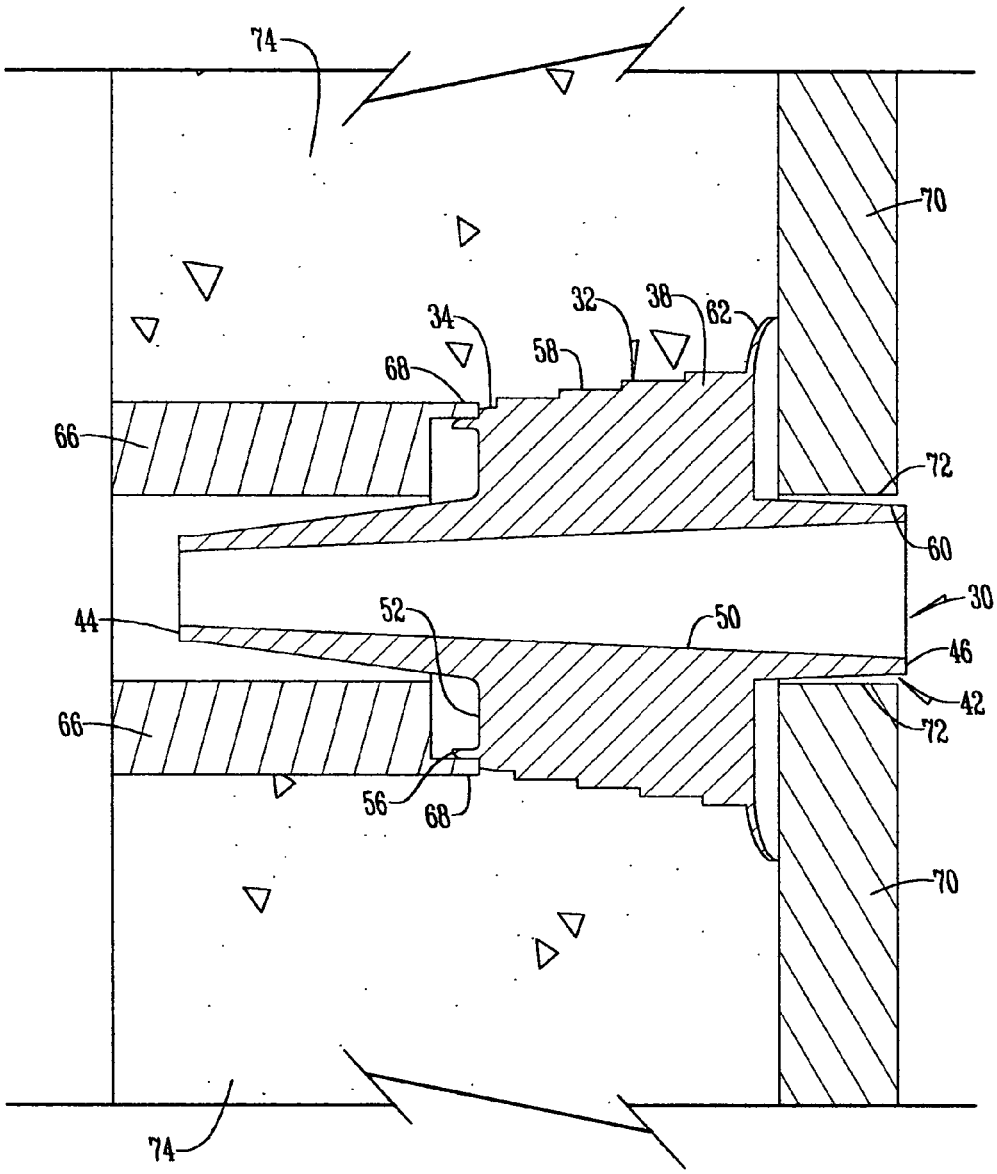
FIG. 7 is a partial cross-sectional view of the pocket former of the present invention as taken across lines 6—6 of FIG. 4 within a concrete substrate.

With reference to FIG. 7, in use, the pocket former 30 is connected to a free anchor 66. As shown, the annular ridge 56 is fitted to a collar 68 of the free anchor 66. Alternatively, the pocket former 30 is sized to fit on the outside of the collar 68 of the free anchor 66.

Placed adjacent to the distal lip 46 is a concrete form 70. The concrete form 70 has an opening 72 through which a portion of the center barrel 42 extends. When assembled, the center barrel 42 of the pocket former 30 is received within an opening 72 in the concrete form 70. The concrete form 70 presses against the annular flange 62 on the outer barrel 32 to form a seal. The concrete is then poured within the concrete form 70 between the concrete forms 70 and over the pocket former 30 to form a concrete substrate 74 about the outer barrel 32 and annular flange 62 of the pocket former 30. As noted above, the annular flange 62 forms a seal or gasket between the concrete substrate 74 and the concrete form 70, preventing leakage of concrete between the pocket former 30 and the concrete form 70 and into opening 72.

Once the concrete substrate 74 is cured, the concrete form 70 is removed, providing access to the pocket former 30. As noted above, removal of the pocket former 30 is facilitated by the application of rotational force on the nut surface 60 of the pocket former 30 by a standard hand tool. This rotation results in the center barrel 42 rotating its position relative to the outer barrel 32 with the ribs 54 pulling the outer barrel 32 inward and away from the surrounding concrete. Additionally, with the rotating motion, the spiral surface 58 substantially improves the mechanical advantage a person can exert upon the interface between the concrete substrate 74 and the pocket former 30.

Figure 8:
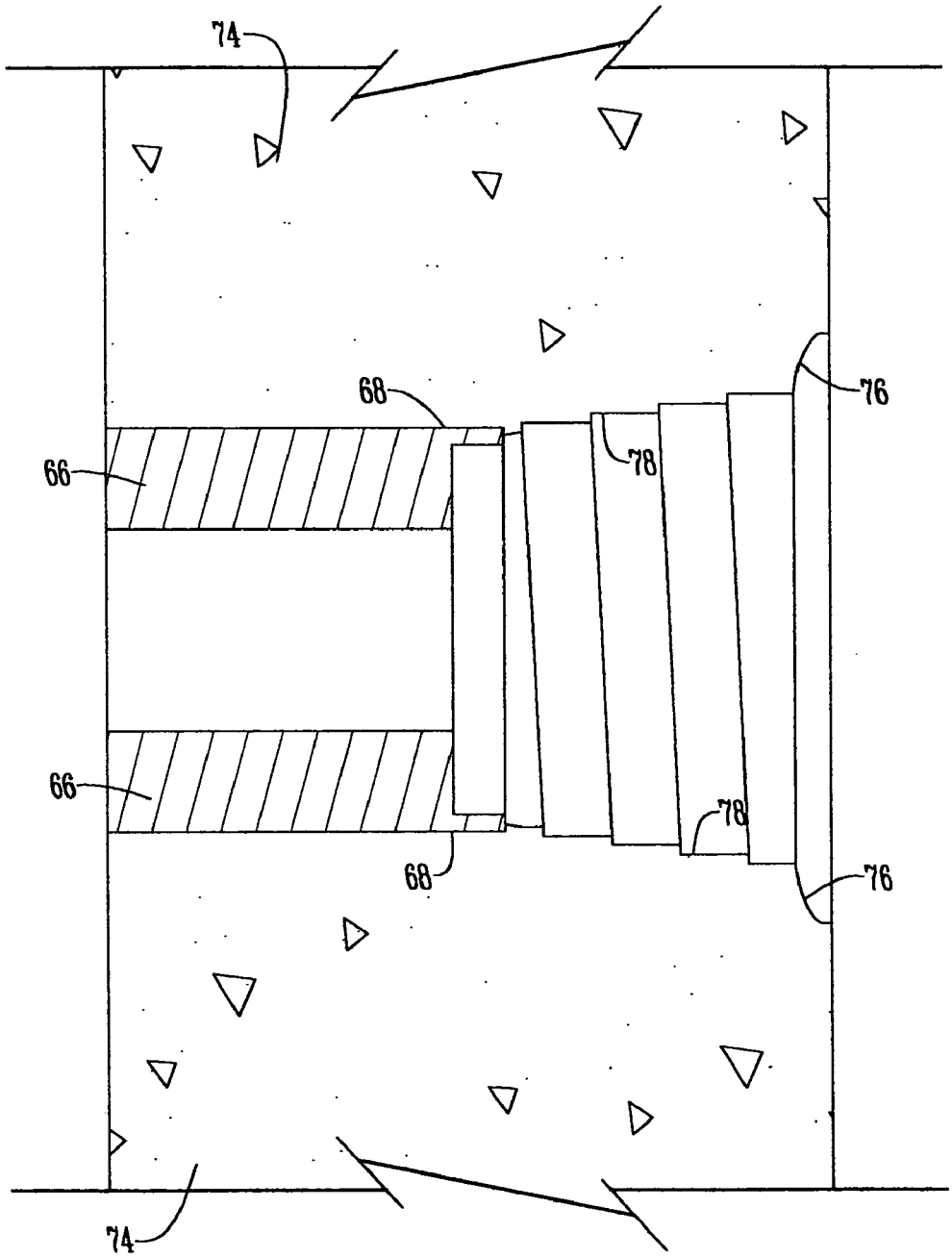
FIG. 8 shows a partial cross-sectional view of the concrete substrate of FIG. 7 with the pocket former removed.

With reference to FIG. 8, once the pocket former 30 has been removed, the concrete substrate 74 includes an outer edge 76 formed at the interface of the annular flange 62 and the concrete form 70. A pocket surface 78 extends from the outer edge 76 inwardly toward the free anchor 66. The pocket surface 78 has a spiral shape formed from its contact with the spiral surface 58 of the pocket former 30. The pocket surface improves the adhesion of sealing grout, as the angular surfaces created by the spiral surface 58 provide a mechanical lock between the concrete and the grout. Further, these angular surfaces created by the spiral surface 58 provide added surface area which further prevents water, salts and other corrosives from entering the anchor area and corroding and weakening the anchor 66.

It will be appreciated by those skilled in the art that other various modifications could be made to the device without departing from the spirit in scope of this invention. All such modifications and changes fall within the scope of the claims and are intended to be covered thereby.

What is claimed is:

1. A pocket former, comprising:

an outer barrel having a first rim, a second rim and a frustoconical body portion extending from the first rim to the second rim;

a center barrel connected to the outer barrel, positioned centrally within the outer barrel and extending beyond both the first rim and the second rim, the center barrel having a proximal lip adjacent the first rim of the outer barrel, a distal lip adjacent the second rim of the outer barrel, and a tubular body portion extending from the proximal lip to the distal lip; and an annular flange that curves out and away from the second rim of the outer barrel.

2. The pocket former of claim 1, further comprising a spiral surface located on the frustoconical body portion of the outer barrel.

3. The pocket former of claim 2, further comprising a nut surface located on the tubular body portion of the center barrel adjacent the distal lip.

4. The pocket former of claim 1, further comprising a nut surface located on the tubular body portion of the center barrel adjacent the distal lip.

5. The pocket former of claim 1, wherein the tubular body portion has a central opening therethrough, extending from the proximal lip to the distal lip, and wherein the tubular body portion is generally tapered from the proximal lip downwardly toward the distal lip.

6. The pocket former of claim 1, further comprising an annular shoulder connecting the first rim of the outer barrel to the tubular body portion of the center barrel, wherein the annular shoulder is oriented to be perpendicular to a longitudinal axis of both the outer barrel and the center barrel.

7. The pocket former of claim 6, further comprising an annular ridge positioned adjacent the first rim of the outer barrel on the annular shoulder, and extending outwardly from the annular shoulder in the direction of the proximal lip of the center barrel.

8. The pocket former of claim 1, further comprising a plurality of cross ribs extending between the tubular body portion of the center barrel and the frustoconical body portion of the outer barrel, wherein the cross ribs are oriented to extend radially from a longitudinal axis of both the outer barrel and the center barrel.

9. The pocket former of claim 1, wherein the pocket former is formed of a unitary body.

10. A pocket former, comprising:

an outer barrel having a first rim, a second rim and a frustoconical body portion extending from the first rim to the second rim;

a center barrel connected to the outer barrel, positioned centrally within the outer barrel and extending beyond both the first rim and the second rim, the center barrel having a proximal lip adjacent the first rim of the outer barrel, a distal lip adjacent the second rim of the outer barrel, and a tubular body portion extending from the proximal lip to the distal lip; and a spiral surface located on the frustoconical body portion of the outer barrel.

11. The pocket former of claim 10, further comprising a nut surface located on the tubular body portion of the center barrel adjacent the distal lip.

12. The pocket former of claim 10, wherein the tubular body portion has a central opening therethrough, extending from the proximal lip to the distal lip, and wherein the tubular body portion is generally tapered from the proximal lip downwardly toward the distal lip.

13. The pocket former of claim 10, further comprising an annular shoulder connecting the first rim of the outer barrel to the tubular body portion of the center barrel, wherein the annular shoulder is oriented to be perpendicular to a longitudinal axis of both the outer barrel and the center barrel.

14. The pocket former of claim 13, further comprising an annular ridge positioned adjacent the first rim of the outer barrel on the annular shoulder, and extending outwardly from the annular shoulder in the direction of the proximal lip of the center barrel.

15. The pocket former of claim 11, further comprising a plurality of cross ribs extending between the tubular body portion of the center barrel and the frustoconical body portion of the outer barrel, wherein the cross ribs are oriented to extend radially from a longitudinal axis of both the outer barrel and the center barrel.

16. The pocket former of claim 11, wherein the pocket former is formed of a unitary body.

* * * * *